United States Patent [19]

Watts, Jr.

[11] 4,319,443

[45] Mar. 16, 1982

[54] FILM WRAPPING MACHINE

[75] Inventor: Ridley Watts, Jr., Gates Mills, Ohio

[73] Assignee: Nordson Corporation, Amherst, Ohio

[21] Appl. No.: 80,138

[22] Filed: Sep. 28, 1979

[51] Int. Cl.[3] ..... B65B 11/08

[52] U.S. Cl. ..... 53/466; 53/493; 53/553; 53/229; 198/485; 198/746

[58] Field of Search ..... 53/463, 466, 228, 229, 53/553, 493; 198/460, 718, 738, 740, 746, 485, 487

[56] References Cited

U.S. PATENT DOCUMENTS

| | | | |
|---|---|---|---|
| 2,379,937 | 7/1945 | Sloan | 53/553 X |
| 2,931,148 | 4/1960 | Smith | 53/493 |
| 3,150,975 | 9/1964 | Schooler | 53/228 X |
| 3,283,473 | 11/1966 | Ghen | 53/228 |
| 3,412,525 | 11/1968 | Heinzer | 53/232 X |
| 3,485,339 | 12/1969 | Miller | 198/460 |
| 3,504,476 | 4/1970 | Ehrenfreid | 53/229 |
| 3,513,622 | 5/1970 | Timmerbeid | 53/553 |
| 3,515,254 | 6/1970 | Gary | 198/572 |
| 3,559,367 | 2/1971 | Misik | 53/229 |
| 3,665,673 | 6/1972 | Billet | 53/228 |
| 3,672,116 | 6/1972 | Ingmarson | 53/229 |
| 3,739,547 | 6/1973 | Brevko | 53/230 |
| 3,869,844 | 3/1975 | Edoward | 53/557 |
| 4,035,983 | 7/1977 | Shanklin | 53/76 |
| 4,070,851 | 1/1978 | Schoppee | 53/228 |
| 4,075,815 | 2/1978 | Carver, Jr. | 53/228 X |

FOREIGN PATENT DOCUMENTS

| | | | |
|---|---|---|---|
| 2432679 | 1/1975 | Fed. Rep. of Germany | 53/228 |
| 2856849 | 7/1979 | Fed. Rep. of Germany | 53/228 |
| 2824753 | 12/1979 | Fed. Rep. of Germany | 53/229 |

*Primary Examiner*—John Sipos

*Attorney, Agent, or Firm*—Watts, Hoffmann, Fisher & Heinke Co.

[57] ABSTRACT

A machine in which a wrapping film extends across a path in which articles to be packaged are moved. The film is drawn from supply rolls above and below the path as an article or group of articles is moved along the path. The film is brought together and sealed behind the article or group of articles to form a tube, the tube is severed from the remaining film, and the remaining film is sealed together. The tube is then thermally shrunk. A cutting and sealing bar movable along a path inclined at an acute angle with the conveying path in part wraps the film about the article or group of articles, and severs and seals the film. An upright frame carries and guides the cutting and sealing bar and is adjustable about a pivot in the plane of the conveying path to vary the angle at which the cutting and sealing bar moves with respect to the conveying path. A film supply roll is carried by the frame so the path of the film from the supply roll relative to the frame is independent of the frame adjustment. The force with which the cutting and sealing bar is driven is reduced during lowering of the bar to avoid damage or injury if movement is obstructed. An article pusher positively advances articles for wrapping past the initial plane of the wrapping film and the path of the cutter bar movement, under control of an electric eye that prevents infeed of a subsequent article or group of articles until a preceding wrapping cycle is complete.

9 Claims, 21 Drawing Figures

FILM WRAPPING MACHINE

BACKGROUND OF THE INVENTION

1. Field of the Invention

This invention relates to a wrapping machine for packaging or bundling articles, typically in a thermo-shrinkable film.

2. Prior Art

Machines for moving an article or groups of articles through the plane of a continuous film, wrapping the article or articles with the film, sealing the film into a tube, severing the tube and resealing the film, and then shrinking the tube about the article or articles, are exemplified by U.S. Pat. Nos. 3,191,356; 3,357,151; 3,488,912; 3,490,194; 3,552,091; 3,830,036; and 3,869,844. Basically, such machines provide a generally horizontal conveyor for articles and extend a film vertically across the path from supply rolls above and below. An article or group of articles is moved through the plane of the film, which is fed or pulled from the supply rolls so the article or articles to be packaged or wrapped move over a portion of the film fed from below while another portion of the film is drawn from above, over the front and top of the article or group of articles. A moving bar pulls the film from above down behind the article or articles and clamps the film portions from above and below together behind the article or articles to form a tube. The clamped film is sealed across the width of the film along two spaced lines and is severed between the lines. This results in a sealed tube about the article or articles, which is separate from the remaining film, of which the upper and lower portions are sealed into a single web for the next article or group of articles to intercept. The article or articles and tubular wrapping are then moved through a heated environment to shrink the tube.

Many of the machines shown in the prior art or in existence are both expensive and complex. Also, where a variety of product sizes and shapes are to be packaged, a particular machine configuration may be inefficient for some of the sizes or shapes. In addition, with small and lightweight articles, typical conveying approaches are often inadequate to assure movement past the plane of the wrapping film. In particular, with tall articles, known techniques apply excess tension to the film as it is wrapped behind the article, or excess film is used to avoid the tension. Such tension may tip the article or articles, or tear the film. Excess film is of course wasteful and undesirable in the finished package.

SUMMARY OF THE INVENTION

The present invention overcomes the above disadvantages and provides additional advantages over known machines through a number of innovative features.

One principal feature of this invention is the establishment of a path for movement of a cutting and sealing bar at an acute angle to the article support, so the bar has a component of movement in the direction of article travel as the bar moves toward the article support. With this arrangement, as the moving bar pulls film down behind an article to form a tube about the article, it will not unduly tension the film that extends across the top of the article. Rather, enough film will extend behind the article to be brought down and in behind the article by the moving bar, without substantial tension and without substantial excess or waste of film (i.e., without forming a tube of excessive size).

An upright frame establishes the inclined path of movement for the cutting and sealing bar and is made pivotally adjustable at the support plane of the articles so the most efficient angle of bar movement can be established for the particular height of the product being wrapped. A film roll for supplying film from above the conveying path is carried by the adjustable frame so the relationship of the initial film path to the path of the cutting and sealing bar is the same through all adjustments.

An advantageous safety feature is achieved through a variable force drive for the cutting and sealing bar to reciprocate it between an upper position that allows the passage of articles to be wrapped, and a lower position to which it is moved to draw film behind the article or articles and to seal and sever the film. The bar is mechanically driven through a drive train that includes a voltage-controlled clutch by which the force transmitted when the bar is lowered is substantially less than the force that can be transmitted for final clamping of the film and for raising of the bar. By utilizing the force of gravity during the lowering of the bar, a relatively small driving force lowers the bar with adequate speed and force until the bar approaches the lower limit of travel. By reducing the voltage to the drive clutch until the bar is almost lowered, the force exerted on any object within the path of bar movement is substantially diminished and damage to the machine drive and the object is minimized. The voltage to the clutch is increased in response to the bar reaching its lower position, at which time the greater force necessary to clamp the film is applied and at which time there is little or no danger of any object being improperly beneath the bar.

To assure proper movement of articles for wrapping, as they are advanced through the initial plane of the wrapping film, a positively driven pusher bar is reciprocated in the direction of article travel to engage and advance an article or articles through and beyond the plane of movement of the cutting and sealing bar. In particular, small or lightweight articles moved along the conveying path by a moving support cannot satisfactorily depend upon friction for transmitting adequate conveying force when the articles contact the film, which must then be moved forward by the articles as they are conveyed through the plane of cutting and sealing bar movement. The pusher bar positively engages the trailing end surface of an article or group of articles and moves them past the path of cutting and sealing bar movement and then returns to a position behind the path. Only after the pusher bar returns to a position behind the cutting and sealing bar path, can the bar be lowered. Return movement of the pusher bar assures that no subsequent article is at that time in the path of cutter bar movement because its return would physically draw such a subsequent article rearwardly of the cutting bar path.

Separately driven infeed and outfeed conveyors are provided on opposite sides of the plane of movement of the cutting and sealing bar. Operation of the conveyors is controlled by an electric eye or scanner on the infeed side of the plane of cutting bar movement. The electric eye serves to sense two conditions and its output is altered to provide an appropriate response. Initially, the electric eye output responds to the trailing end of an article that has moved through the beam of the eye to initiate operation of the pusher bar. After the pusher bar has withdrawn, the cutting and sealing bar begins its downward movement. Thereafter, the electric eye output responds to the leading edge of an article to stop the infeed conveyor. Thus, a subsequent article cannot be fed into the plane of the cutting and sealing bar once the bar has begun its downward movement. Upon return of the cutting and sealing bar to its raised position, the output of the electric eye will again be in response to the trailing edge of an article. With this arrangement, a single sensor operates in two modes and thereby accommodates articles of varying length without machine adjustment.

The above and other features and advantages of the invention will become more apparent from the detailed description that follows, when considered in connection with the accompany drawings.

DETAILED DESCRIPTION

Figure 1:
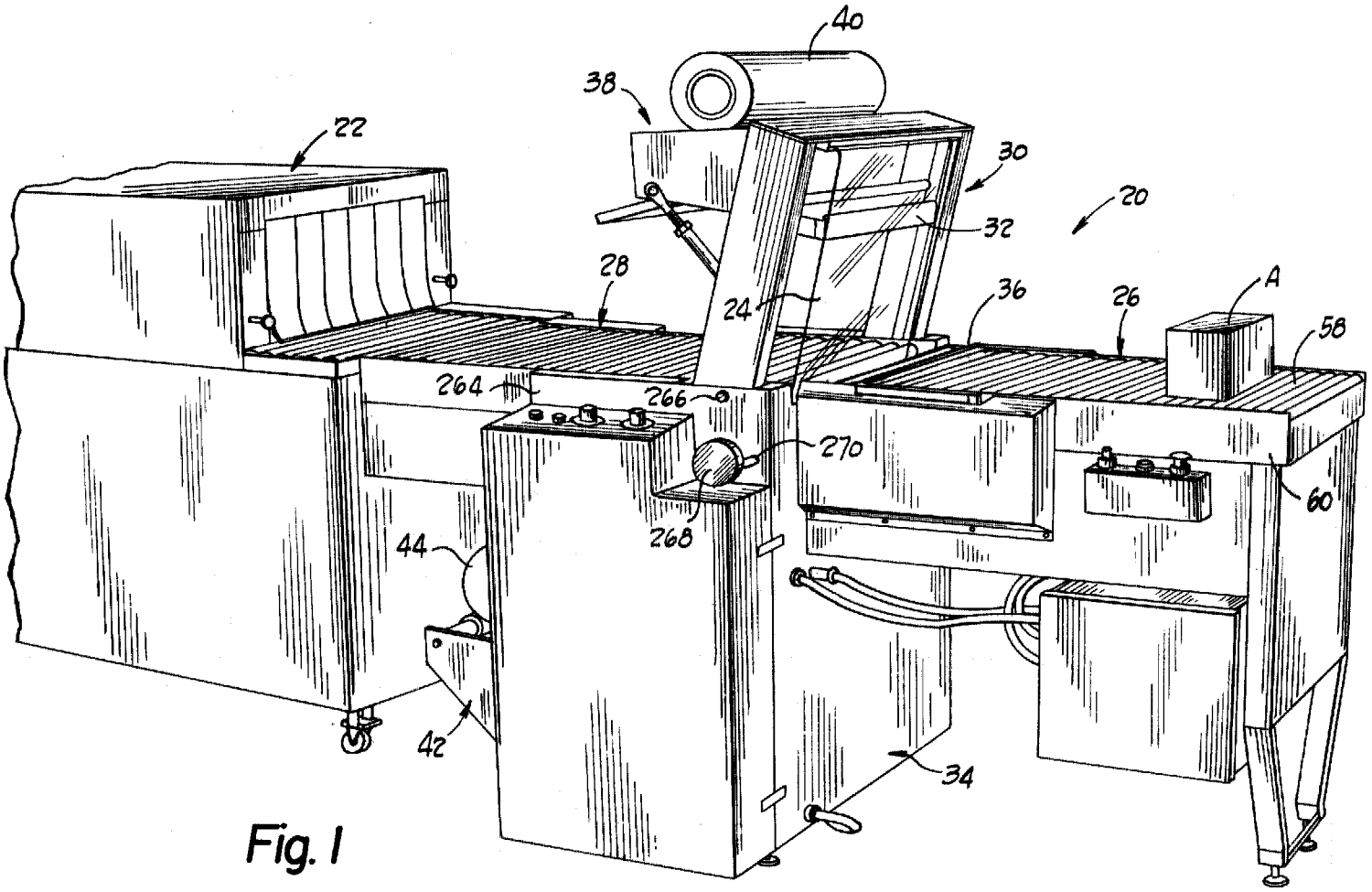
FIG. 1 is a perspective view of a film wrapping machine embodying the present invention.

A wrapping machine 20 embodying the present invention is shown in FIG. 1 along with a conventional shrink tunnel 22. The machine and tunnel are used for wrapping or bundling articles in plastic film 24 and thermally shrinking the film tightly about the wrapped article.

The wrapping machine 20 includes an infeed conveyor 26 for moving articles A to be wrapped, an outfeed conveyor 28 for moving wrapped articles to the shrink tunnel 22, and an angularly adjustable frame 30 above the plane of the conveyors for supporting the film 24 in a transverse plane between the conveyors 26, 28 and for guiding a cutting and sealing bar (hereafter "seal bar") 32 in movement toward and away from the conveying plane. All are supported on a base structure 34.

A pusher bar assembly 36 is associated with the infeed conveyor, adjacent the frame 30. An upper support and feed mechanism assembly 38 is supported at the top of the frame 30 for supplying the film 24 from a roll 40. A lower support and feed mechanism 42 is provided on the base structure 34 beneath the conveying path for a roll 44 of film. The film 24 is continuous between the two rolls.

Figure 2:
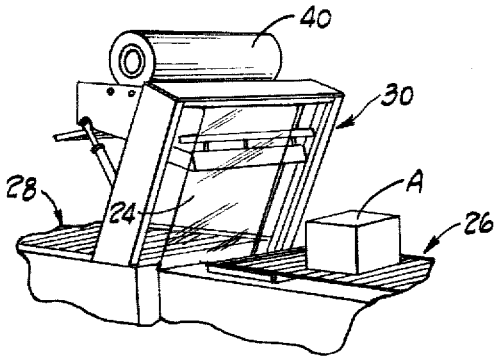
FIG. 2 is a partial perspective view of the machine of FIG. 1, illustrating an article about to be wrapped.
Figure 3:
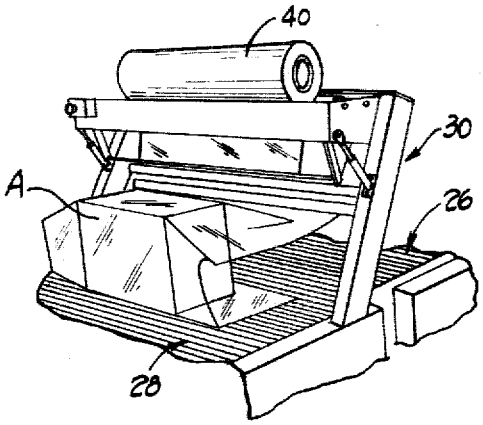
FIG. 3 is a partial perspective view of the apparatus of FIG. 1, taken from the outfeed conveyor side of the apparatus, illustrating an article partially wrapped.

The basic operation of the wrapping machine is illustrated in FIGS. 2–4, which show by way of example an article A moved on the infeed conveyor 26 in a path that takes it over the pusher bar 36 (FIGS. 2 and 4A) and then through the plane of the film 24 with assistance from the pusher bar. The film is fed from the rolls 40, 44 above and below the conveying plane so the article moves onto the film 24 on the outfeed conveyor (FIGS. 3 and 4B) while at the same time the film is wrapped over the top of the article. The seal bar 32 is at an upper position on the frame 30 (FIGS. 2, 3, 4A and 4B) as the article approaches the film, and is then lowered (FIGS. 4C, 4D) after the article passes through the original plane of the film. Lowering of the seal bar pulls the film down behind the article, where it seals the film into a tube, severing the tube and resealing the film from the upper roll to the film from the lower roll (FIG. 4D).

Three significant features of the apparatus and its operation are illustrated diagrammatically in FIGS. 4A–4D:

(1) The pusher bar 36, initially recessed in the conveyor, is raised and moves the article into and through the path of the film under positive mechanical force, without relying upon frictional conveying, which is important when small, lightweight, articles are being conveyed. The pusher bar operates in response to the sensing of the trailing end of an article by a phototube 46 (FIG. 4B) and is automatically withdrawn, taking with it any subsequent article that has advanced too far on the infeed conveyor.

(2) The frame 30 and film 24 extends at an acute angle and the seal bar moves at an acute angle with respect to the infeed conveyor so the bar moves with a component in the direction of article travel when it is lowered. This reduces tension on the film brought over and behind the article being wrapped, and locates the seal close to the bottom back edge of the article, minimizing the amount of film required and reducing the tension on the film, which tends to tear the film or tip the article.

Figure 4A:
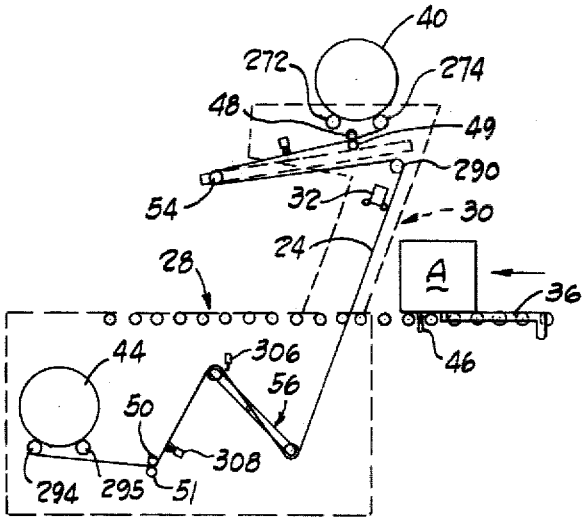
FIGS. 4A–4D are diagrammatic partial side elevational views of the machine of FIG. 1 illustrating the sequence of article movement and film wrapping of the article.
Figure 4B:
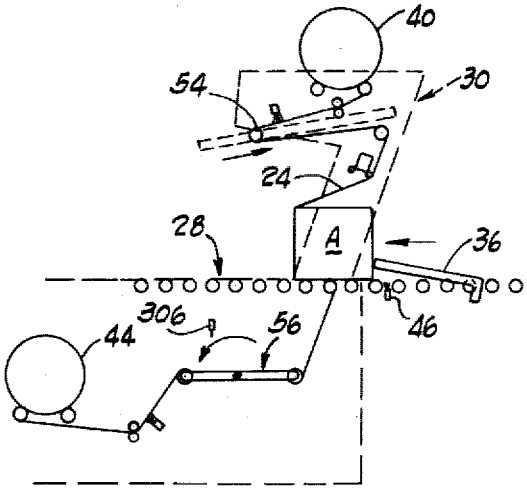
Figure 4C:
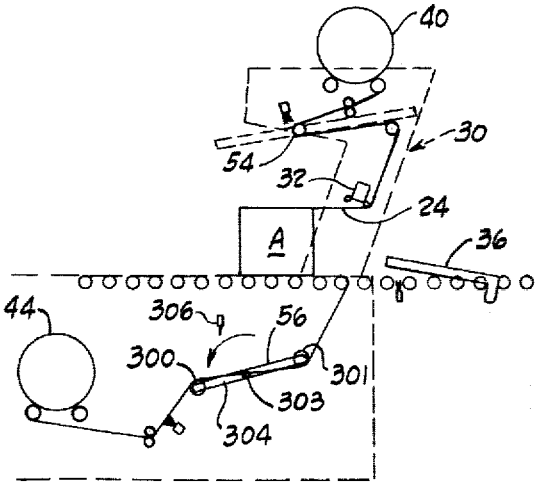

(3) The film 24 is fed from supply rolls 40, 44 by driven pinch rolls 48, 49 associated with the roll 40, and pinch rolls 50, 51 associated with the supply roll 44. The pinch rolls are operated by switches sensitive to the tension on the film created by an article moved into the plane of the film. The film from the upper roll is trained over a dancer roll 54, which when moved operates a switch controlling the drive to the pinch rolls 48, 49. The film from the lower supply roll is trained over a bale 56 that rotates in response to tension on the film, opening a switch that controls the drive of the pinch rolls 50, 51. The dancer roll and bale also provide slack in the film to accomodate temporary differences in demand of the film over the feed drive, as illustrated in FIG. 4C by the rearward position of the dancer roll and the rotated position of the bale.

Figure 5:
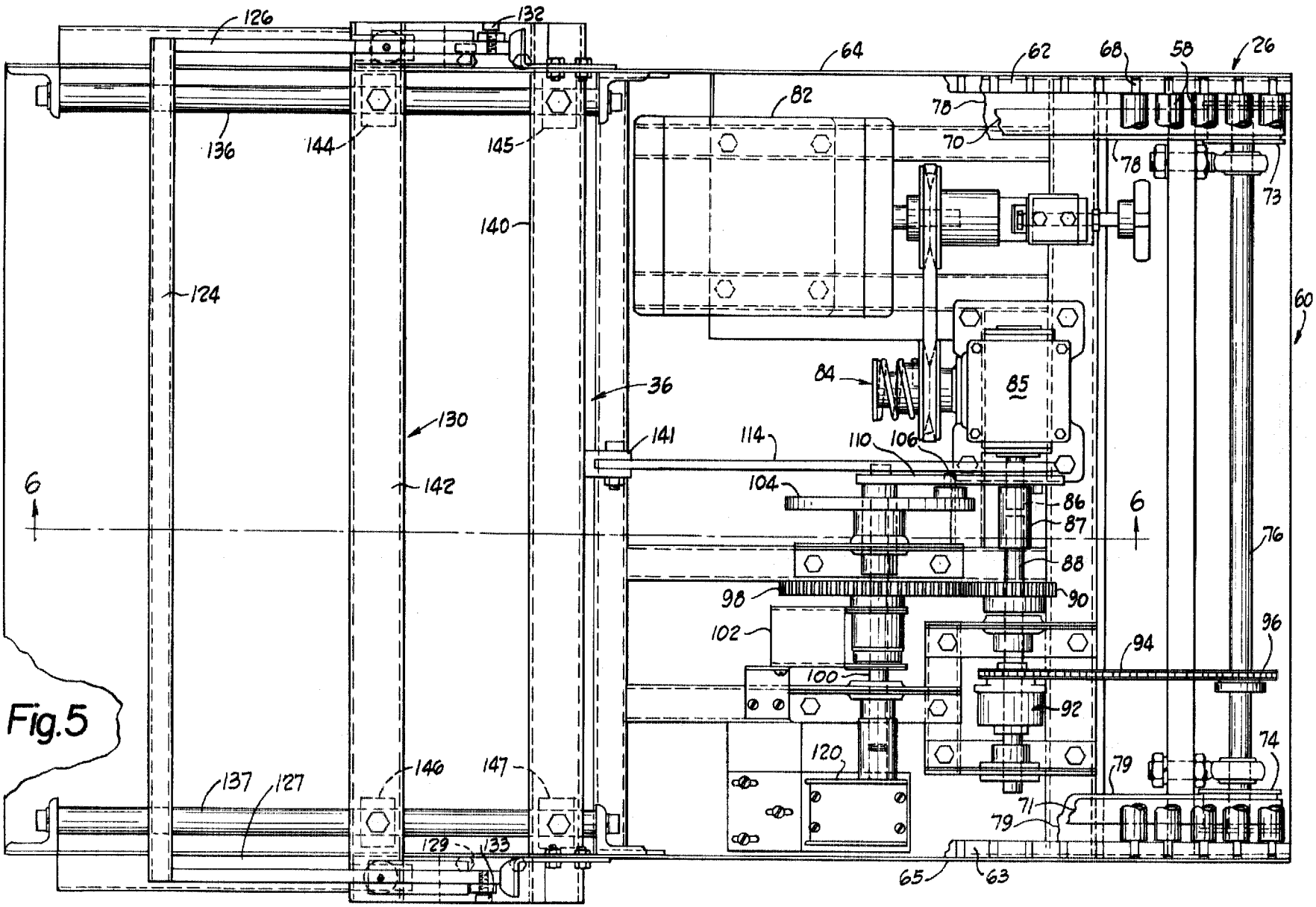
FIG. 5 is a top plan view, with parts removed, illustrating the infeed conveyor and drive mechanism for the conveyor and a pusher bar.
Figures 6, 7:
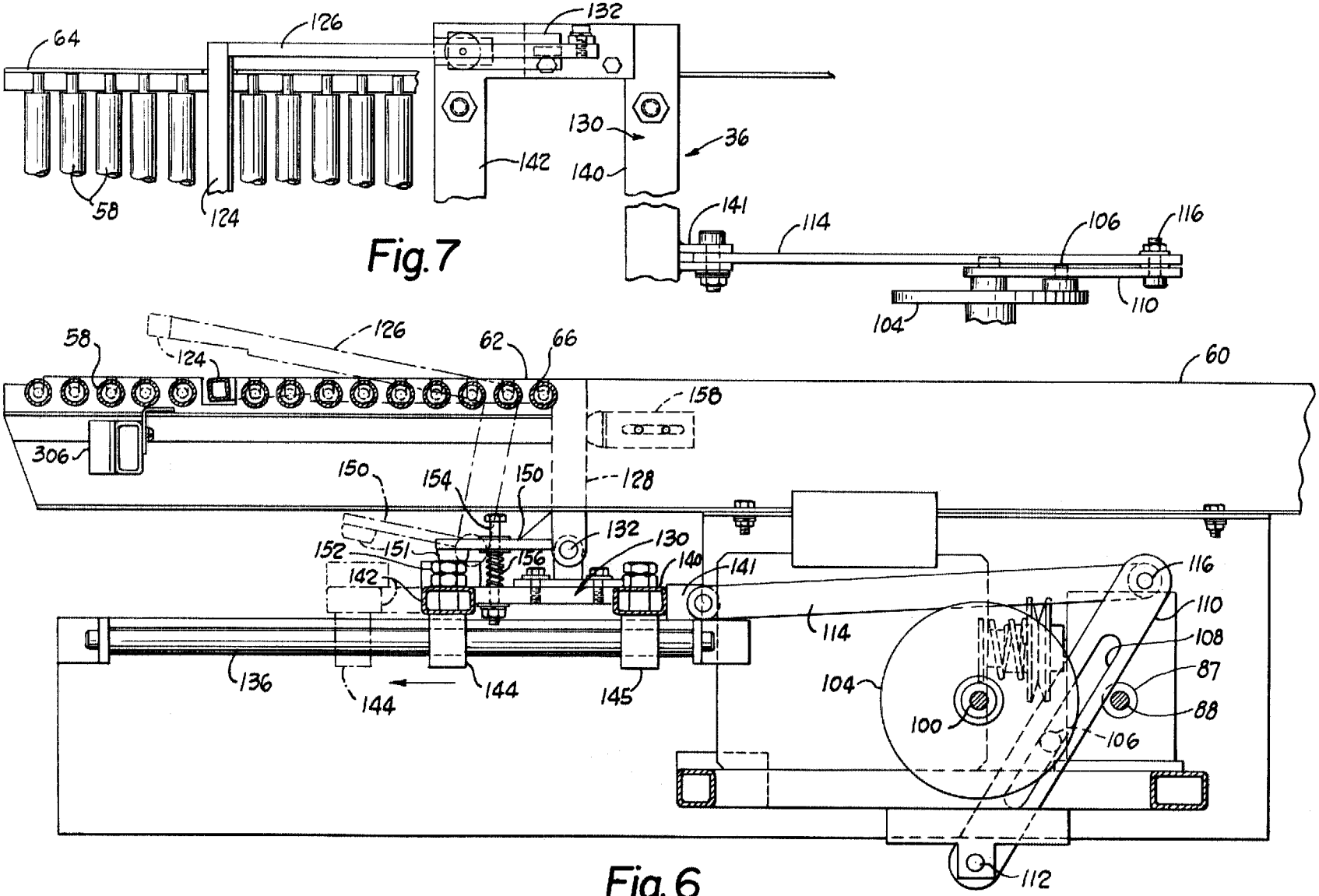
FIG. 6 is a longitudinal sectional view, with parts in elevation, of the infeed conveyor and pusher bar mechanism illustrated in FIG. 5, taken along the line 6—6.
FIG. 7 is a partial top plan view of the pusher bar mechanism of FIG. 6.

The construction of the infeed conveyor 26 and its drive, the pusher bar assembly 36 and its drive, are shown in FIGS. 5–7.

The infeed conveyor 26 has closely spaced horizontal rolls 58 in a horizontal top frame 60 supported on the base structure 34. Longitudinal roll supports 62, 63 (FIG. 5) are secured on opposite sides of the horizontal top frame to longitudinal side rails 64, 65, respectively. The roll supports have spaced vertical slots 66 in which stub shafts 68 of the rolls 58 ride.

Opposite ends of the rolls 58 ride on continuous belts 70, 71 trained along opposite longitudinal side rails 64, 65 by longitudinal spaced pulleys at opposite ends, the pulleys 73, 74 being shown in FIG. 5, carried by a transverse drive shaft 76. Each belt 70, 71 rides on a respective support plate 78, 79 along the longitudinal side rails 64, 65. The weight of the rolls and any articles carried by the rolls creates a normal force between the rolls and the moving belts, and the belts rotate the rolls, which convey the articles.

The belt drive shaft 76 is driven by an electric motor 82 through a variable speed pulley drive 84 and transmission 85, which has an output shaft 86 connected by a coupling 87 to an intermediate drive shaft 88 secured to the horizontal top frame 60. The intermediate shaft 88 carries a pinion 90 and a chain sprocket and clutch 92. The chain sprocket and clutch 92 drive a chain 94 to a sprocket 96 on the drive shaft 76. The motor 82 is driven continuously and drive of the input conveyor is controlled through the clutch portion of the chain sprocket and clutch 92. This infeed conveyor clutch is engaged through a coil 1CLU, shown in the circuit-diagram of FIG. 18.

The pinion 90 drives a gear 98 upon a shaft 100 parallel to the intermediate shaft 88. The gear 98 is coupled to the shaft 100 through a one-revolution clutch 102 so energization of the clutch 102 through a coil 3CLU and a time controlled switch 4TR-2 results in one revolution of the shaft 100 through the gear 98. A drive disk 104 is fixed to the shaft 100 for driving the pusher bar assembly 36. A stub shaft 106 extending from the drive disk 104 is received in a slot 108 of an oscillated arm 110 secured by a pivot 112 at its lower end to the upper frame. The arm 110 is reciprocated or oscillated back and forth each time the drive disk 104 makes one revolution, upon actuation of the one-revolution clutch 102. The arm 110 drives the pusher bar assembly 36 through a generally horizontal link 114 connected at a pivot 116 to the upper end of the arm 110. A cam switch assembly 120 associated with the shaft 100 has two cam switches FLS and RLS operated from the shaft 100 so the switches are opened and closed in timed relationship to the oscillation of the arm 110 and hence the reciprocation of the pusher bar assembly 36. The cam switch RLS is set so that when the shaft 100 rotates to position the oscillating arm 110 and pusher bar assembly 136 at its most forward position, the cam switch will be operated, disengaging and hence stopping the conveying of the outfeed conveyor 28 by controlling an outfeed conveyor clutch 182, subsequently described. This allows a package pushed onto the outfeed conveyor to remain stationary during completion of the wrapping operation. The second cam actuated switch FLS is closed when the shaft 100 has rotated the disk 104 to a position that retracts the pusher bar assembly to a position behind the plane of movement of the seal bar 32 and permits the seal bar to be lowered.

The pusher bar assembly 36 is shown in retracted and lowered position in FIGS. 5 and 7 and in solid line in FIG. 6. In the retracted position it is located behind the film plane and path of seal bar movement, and below the support plane defined by the infeed conveyor rolls 58. The pusher bar assembly has a front piece or transverse bar 124 that extends across the infeed conveyor 26. The bar 124 has rearwardly extending side portions 126, 127, that are L-shaped, terminating in downwardly extending legs 128, 129, respectively. Each downwardly extending leg is secured to a carrier frame 130 by a pivot connection 132, 133, respectively. The carrier frame 130 is supported for reciprocation longitudinal of the infeed conveyor on horizontal slide rods 136, 137 on opposite sides of the conveyor. The carrier frame, as shown in FIGS. 5, 6 and 7 has a U-shaped piece 140 connected by a clevis 141 to the drive link 114, and a front cross piece 142. At each side of the carrier frame, two depending guides 144, 145 and 146, 147 receive the slide rods 136, 137.

As best shown in FIG. 6, a finger 150 extends forwardly from the downwardly extending leg 128 of the pusher bar 124, at the pivot 132. The finger is fixed with respect to the pusher bar, is generally parallel to the side portion 126 and serves as a stop to limit downward movement of the pusher bar. To this end, a pad 151 carried at the distal end of the finger 150 contacts the top of a stop screw 152 on the carrier frame. An intermediate portion of the finger 150 surrounds a stop screw 154 secured to the carrier frame to limit upward movement of the pusher bar by engaging the head of the stop screw 154. A compression spring 156 surrounding the stop screw 154 beneath the finger 150 serves to bias the pusher bar to a raised position, shown in dotted line in FIG. 6.

A fixed abutment 158 carried by the horizontal top frame 60 causes pivotal movement of the pusher bar about the pivots 132, 133 by engaging the downwardly extending leg 128 at its rear surface above the pivot, so when the carrier frame reaches the rear position shown in solid line in FIG. 6, the fixed abutment 158 pivots the pusher bar down to a lowered, recessed position, against the compression of the spring 156. Forward movement of the carrier frame 130 immediately allows the spring 156 to raise the bar 124 to an active pushing position.

Figure 8:
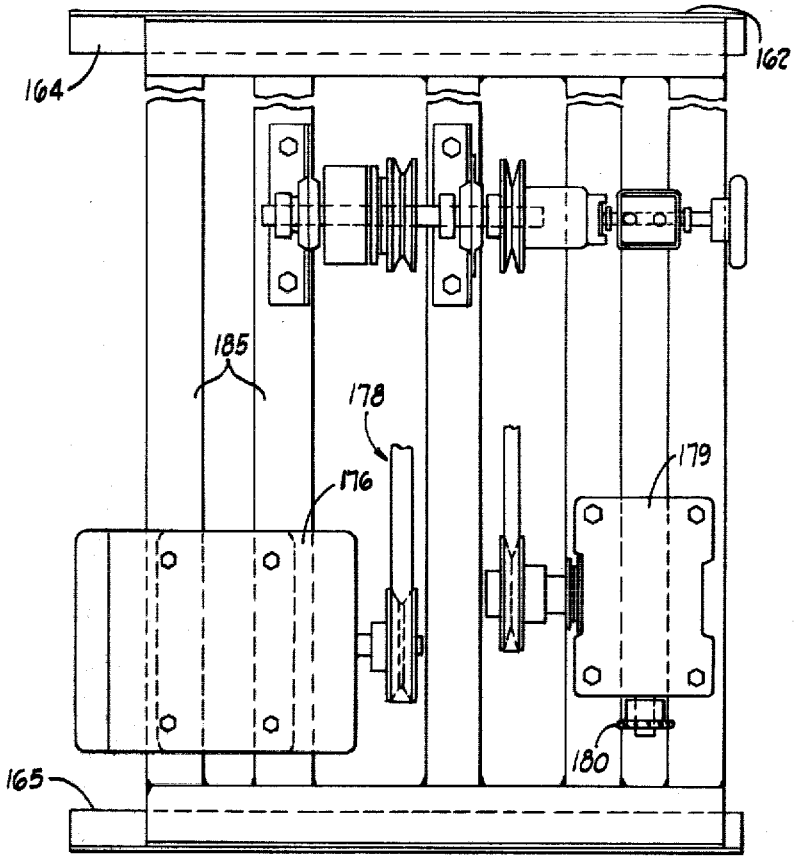
FIG. 8 is a partial top plan view of the outfeed conveyor of the apparatus of FIG. 1, with parts removed, illustrating the drive transmission for the conveyor.
Figure 9:
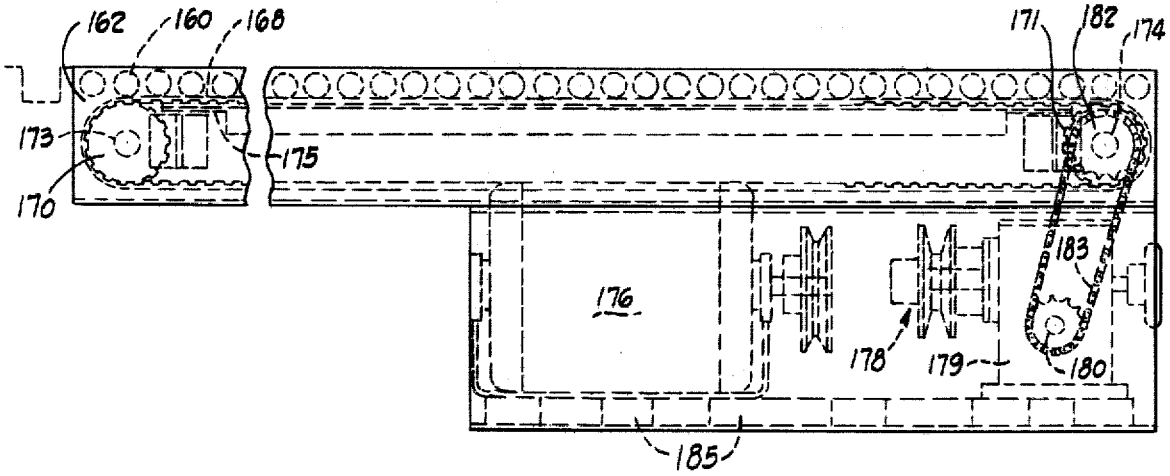
FIG. 9 is a side elevational view with parts broken away, illustrating the outfeed conveyor and drive of FIG. 8.

The construction of the outfeed conveyor 28 is shown in FIGS. 8 and 9 of the drawings. Similar to the infeed conveyor 26, the outfeed conveyor 28 has closely spaced horizontal rolls 160 in a horizontal top frame 162 supported on the base structure 34. Longitudinal roll supports (not shown) are secured on opposite sides of the horizontal top frame to longitudinal side rails 164, 165. The roll supports have spaced vertical slots in which stub shafts of the rolls 160 ride.

Opposite ends of the rolls 160 ride on continuous belts, one belt 168 being shown in FIG. 9. The belts are trained along opposite longitudinal side rails 164, 165 by longitudinally spaced pulleys at opposite ends, the pulleys 170, 171 for the belt 168 being shown in FIG. 9, each carried by a transverse shaft 173, 174, respectively; the shaft 174 being a drive shaft. The weight of the rolls and any articles carried by the rolls creates a sufficient normal force between the rolls and the moving belts so the belts drive the rolls and convey articles. The belts ride on support plates, one plate 175 being shown along the longitudinal side rail.

The belt drive shaft 174 is driven by an electric motor 176 through a variable speed pulley drive 178 and transmission 179 which has an output sprocket 180. The output sprocket drives a chain outfeed sprocket and clutch 182 on the drive shaft 174 through a chain 183. The chain sprocket and clutch 182 drives the shaft 174 when the clutch is engaged upon actuation of a clutch coil 2CLU. The motor, pulley drive and transmission are supported on transverse brackets 185 between the side rails 164, 165, beneath the conveyor rolls.

Upon starting the machine, the electric motor 176 runs continuously. Engagement of the chain sprocket and clutch 182 to the drive shaft 174 to start the infeed conveyor operating occurs when the machine is started. The cam switch RLS stops the outfeed when the pusher bar assembly 36 reaches its forward position, by disengaging the chain sprocket and clutch 182. Rotation of the outfeed conveyor rolls begins again with upward movement of the seal bar 32, in response to operation of a limit switch BLS (to be described) as the seal bar moves away from the lowered sealing position. This operation assures that an article on the outfeed conveyor is removed from a position adjacent the film plane before a new article is moved through the film plane for wrapping and sealing.

The construction of the seal bar 32 and angularly adjustable frame 30 is best shown in FIGS. 12–15. The frame 30 includes two laterally spaced upright side support and drive assemblies 188, 189, between which the seal bar 32 extends. Each side support and drive assembly is a mirror image duplicate of the other and thus like reference numerals will refer to corresponding parts. Each side support and drive assembly includes a support and guide post 190, a surrounding sleeve 192 that moves along the post and supports one side of the seal bar 32, a drive chain 194 connected at opposite ends to the sleeve and trained about upper and lower sprockets 196, 198, all supported within a housing 200. The lower sprockets 198 are connected by a shaft 201 driven by a sprocket 202 secured to the shaft. The sprocket 202 is driven by a chain 204 from a reversible transmission 206 that includes a voltage-sensitive clutch and a solenoid-operated safety brake. The transmission is driven through a chain drive 210 from an electric motor and gear box 212. The voltage-sensitive clutch varies in its engagement force with a change in voltage, applied through a triac. Drive reversal is accomplished through solenoid operated brakes on transmission shafts.

Figure 13:
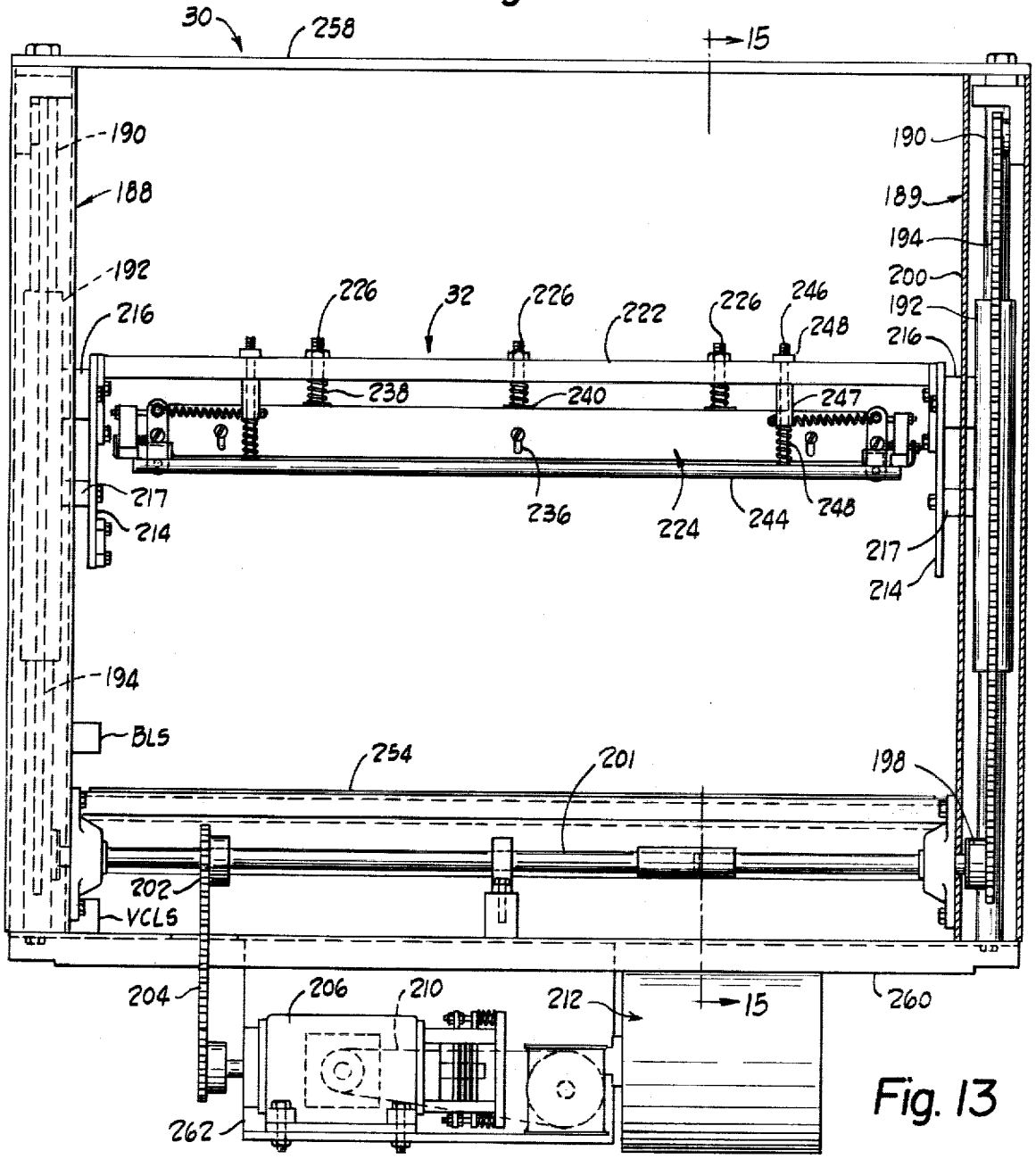
FIG. 13 is an elevational view of the frame of FIG. 12, with parts broken away, viewed from the plane of line 13—13.
Figure 14:
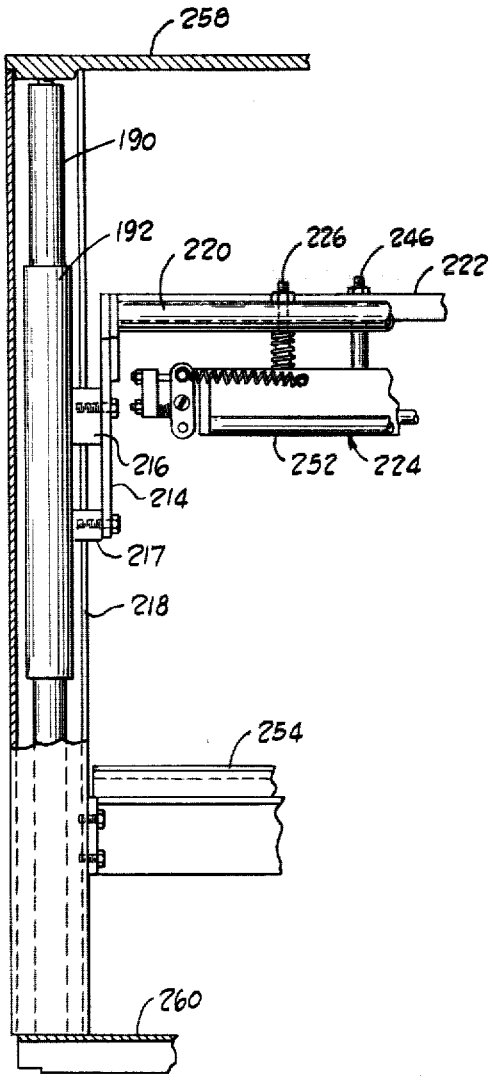
FIG. 14 is partial elevational view showing one end of the frame of FIGS. 12 and 13, as viewed from the line 14—14 of FIG. 12.
Figure 15:
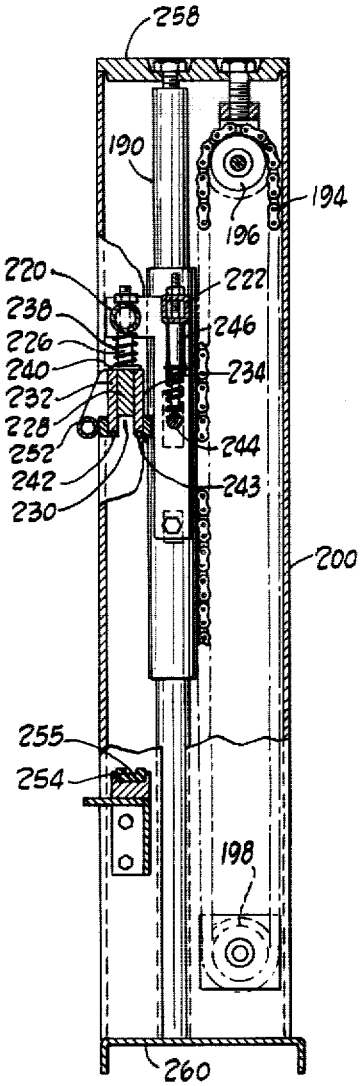
FIG. 15 is a view partly in section and partly in elevation, with parts broken away, of the frame and bar assembly of FIG. 13, taken approximately along the line 15—15.

A support bracket 214 outside each respective housing 200 is connected to two mounting blocks 216, 217 that are secured to the adjacent sleeve 192 within the housing and that project through an open longitudinal slot 218 in the housing, facing inwardly, i.e., toward the opposite housing. Two transverse carrier tubes 220, 222 extend between the opposed support brackets 214. A transverse sealing and severing assembly 224 is secured to the tube 220 by threaded studs 226 from the top of a transverse central plate 228. See FIG. 15. The plate 228 carries a resistance wire heater 230 beneath its lower edge for severing film. The central plate 228 also carries two parallel plates 232, 234, one on each side and movable relative to the central plate through a lost motion connection 236 (FIG. 13) that permits movement of the side plates relative to the central plate in the direction of seal bar movement. Compression springs 238 surround the threaded studs 226 and bias the side plates to a downward position, as illustrated in FIGS. 13 and 15, by a washer 240 that extends across the width of the seal bar. As shown in FIGS. 13 and 15, when the side plates are in their lower position, they extend below the lower edge of the central plate. Each side plate carries along its bottom edge a resistance element 242, 243, which when heated, serves to seal film on opposite sides of the severing wire 230, in a known manner, under control of a simulator circuit that controls the heating and cooling time.

A transverse film guide bar 244 is carried by the other carrier tube 222 at a location adjacent to and in a position parallel to the plates 228, 232, 234. See FIGS. 13 and 15. The film guide bar is supported for relative movement with respect to the carrier tube by upright slide rods 246 that are guided by sleeves 247. Each slide rod has a securing collar 248 fixed to its upper end and is surrounded by a spring 248 that acts between the collar and the film guide bar to bias the bar into the position shown in FIG. 13 and to permit movement of the guide bar toward the carrier tube under force. Also, a transverse film guide bar 252 is carried with the sealing and severing bar 224 on the opposite side of the assembly 224 from the guide bar 244. The two film guide bars restrain the film from contacting the heated elements of the sealing and severing assembly as the seal as the bar moves to draw the film about an article being wrapped.

Figure 4D:
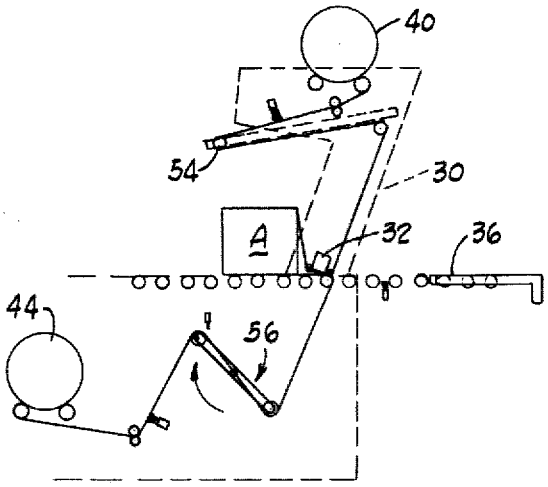

As the seal bar 32 is moved in a downward direction, it draws the film about the article being wrapped and clamps an upper reach and a lower reach of film behind the article, as illustrated in FIGS. 4C and 4D. The two parallel sealing plates 232, 234 cooperate with a transverse anvil 254, which has a central recess 255 to receive the cutting wire 230. The lower edges of the plate 232, 234 and their respective resistance heating elements 242 press against the anvil on opposite sides of the recessed 255 to seal the two reaches of film together along two spaced lines. The wire 230 melts and severs the film between the two seals. As the sealing and severing bar assembly 224 is lowered to seal and sever the film, the two parallel side plates 232, 234 move upward against the compression force of the springs 238, which apply a yieldable force that assures adequate pressure of the seal plates across the width of the film. This allows for any misalignment of the bar from end to end and avoids the need for a critical lower position of the driven sealing and severing bar mechanism, avoiding both insufficient or excessive pressure in the sealing and severing operation.

Figure 12:
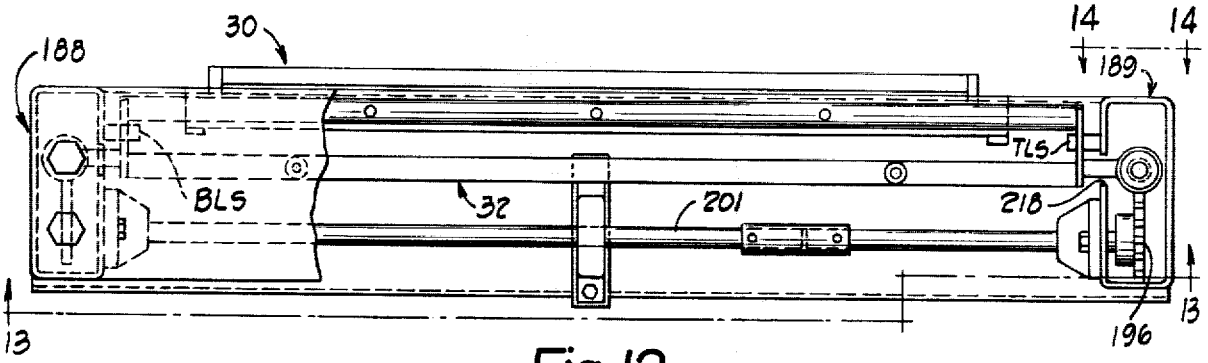
FIG. 12 is a top plan view, with parts broken away, of the frame of FIG. 11 as viewed from the line 12—12.

Control limit switches TLS, VCLS and BLS are located on the frame 30 to be operated by the seal bar 32 as it moves between upper and lower positions. As shown in FIGS. 12 and 13, the limit switch TLS is at the top of the side support 189 and is operated by a cam (not shown) carried by the bar, when the bar is at its upper position. The limit switch VCLS is at the base of the side support 188, positioned to be operated by a lower surface of the sleeve 192 when the seal bar 32 has almost reached the lower sealing postion. The limit switch BLS is located atthe lower end of the side support 188, and is operated by a cam (not shown) carried by the seal bar, when the bar reaches its lower limit of travel.

As soon as the bar 32 begins its downward movement, it opens the limit switch TLS, which alters the circuits of the photoelectric sensor 46 so the sensor will signal the presence of the leading edge a successive article to be packaged, which may be too close behind the previous article, and will thereupon stop the infeed conveyor. When limit switch VCLS is closed as the seal bar 32 approaches the sealing position, it causes a greater voltage to be applied to the voltage-sensitive clutch of the sealing bar drive transmission 206. As a result, the drive is capable of moving the seal bar under greater force, to apply desired clamping pressure with the seal bar against the lower anvil. By only providing such greater voltage when the bar approaches its lower position, a significant advantage is achieved. That is, during the travel of the bar from the upper position to the position at which the voltage control limit switch VCLS is actuated, a reduced voltage actuates the clutch in the drive train. As a result, should an article or other obstruction be beneath the moving seal bar, which is driven under a positive chain drive, clutch slippage will result rather than damage to the article or other obstruction, or to the bar drive mechanism. However, once the bar reaches a lower position, at which point there would no longer be danger of an obstruction in the path of movement, the voltage is increased to assure application of the desired clamping force and to also transmit sufficient force to raise the seal bar against the force of gravity during the upward movement.

When the lower limit of travel of the cutter bar is reached, the bottom limit switch BLS is actuated to temporarily stop the seal bar drive. At the same time, this initiates the sealing cycle, which heats the wires to sever and seal the film. The time during which the sealing and severing takes place is under control of a simulator circuit, which takes into account the fact that the wire may build up heat during continued operation of the machine and provides a suitable preset time during which the film is cut and sealed. After severing, cooling time is allowed for the seal to harden sufficiently to withstand the strain of tension. Thereafter a control relay is energized that causes the seal bar drive to operate in reverse, driving the bar to its upper position, where it closes the top limit switch TLS. This sets the machine back to its original condition, ready for the next article to be moved in on the infeed conveyor for wrapping and sealing.

The frame 30 for the seal bar mechanism is constructed and arranged for angular adjustment relative to the machine frame and in particular relative to the plane of the infeed and outfeed conveyors. To this end, the upright housings 200 and the support and guide posts 190 are secured to upper and lower cross pieces 258, 260 to form a rigid unit. The drive motor unit 212 and associated transmission 206 for the seal bar are suspended from the lower cross piece 260 by a support bracket 262, to be carried with the frame 30 in its adjustment. The entire frame 30 is secured slightly above its lower end to a central portion 264 (FIG. 1) of the machine frame, between the infeed and outfeed conveyors 26, 28, in a manner to permit pivoting about a transverse axis in the plane of the infeed and outfeed conveyors. In the preferred embodiment shown, this is achieved by a pivot bolt 266 on each side of the central support portion 264 of the machine frame, that extends through the adjacent housing 200. At a lower portion of each housing 200, beneath the pivot, a clamp wheel and screw 268 (FIG. 1) is provided on each side that extends through an arcuate slot 270 in the central portion of the machine frame 264. By loosening the hand wheels, the frame 30 can be pivoted from a vertical position to an acute angle with the infeed conveyor. Typically, the angle to which the frame 30 is adjusted is from the 90° vertical position to an angle of about 30° from the vertical toward the infeed conveyor. The more acute angle with the infeed conveyor is especially advantageous with tall articles to reduce tension and use of material.

With the frame 30 in an angled position, i.e., adjusted to form an acute angle with the infeed conveyor, as shown in FIGS. 4C and 4D, the seal bar in its downward movement engages the film being wrapped over the article, at a location spaced longitudinally substantially behind the article. The seal bar then moves into a position adjacent the base of the article, i.e., downward and toward the article to its final sealing position substantially adjacent the article base. As a result, the seal bar to a great extent pivots the film over the top and down the back toward the base of the article, rather than following a path closely adjacent the back of the article as it pulls the film downward, which would apply substantial tension to the film as the bar moves to a sealing position. This is especially significant with tall articles, where the tension is greatest and the tendency may be to tip the article backward or unduly stretch the film as the seal bar moves downward, causing the film to follow the bar close to the surface of the article and perhaps sever the film due to the tension. In addition, this arrangement permits the seal to be located close to the bottom edge of the article, rather than at a position spaced substantially behind the article, significantly reducing the amount of material used to wrap the article.

To best facilitate the angular adjustment of the frame 30 relative to the conveying path, it is advantageous that the path of the film along the frame 30 remain constant relative to the path of seal bar movement along the frame, so the cooperation of the seal bar and film in wrapping the film over an article and drawing it down behind the article is the same for all angles of the frame 30. This is accomplished by supporting the supply roll of film 40 on the frame 30 and training the film from the roll along a path defined by guide rolls carried by the frame and by a roll of the outfeed conveyor, adjacent the pivot axis of the frame.

Figure 10:
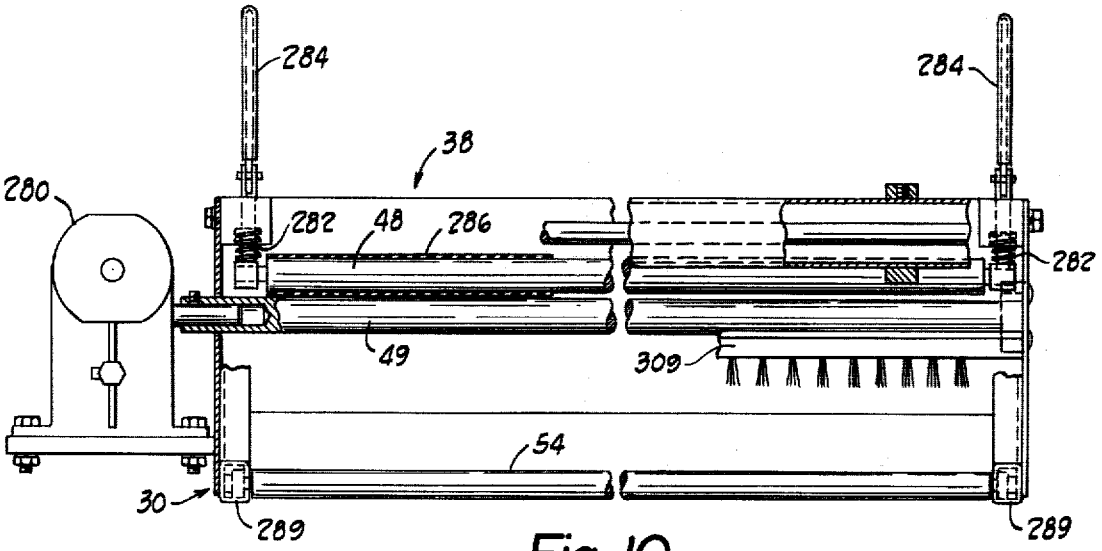
FIG. 10 is a front elevational view, partly in section, of the upper portion of the frame shown in FIGS. 2 and 3, illustrating the film drive rolls and associated mechanisms.
Figure 11:
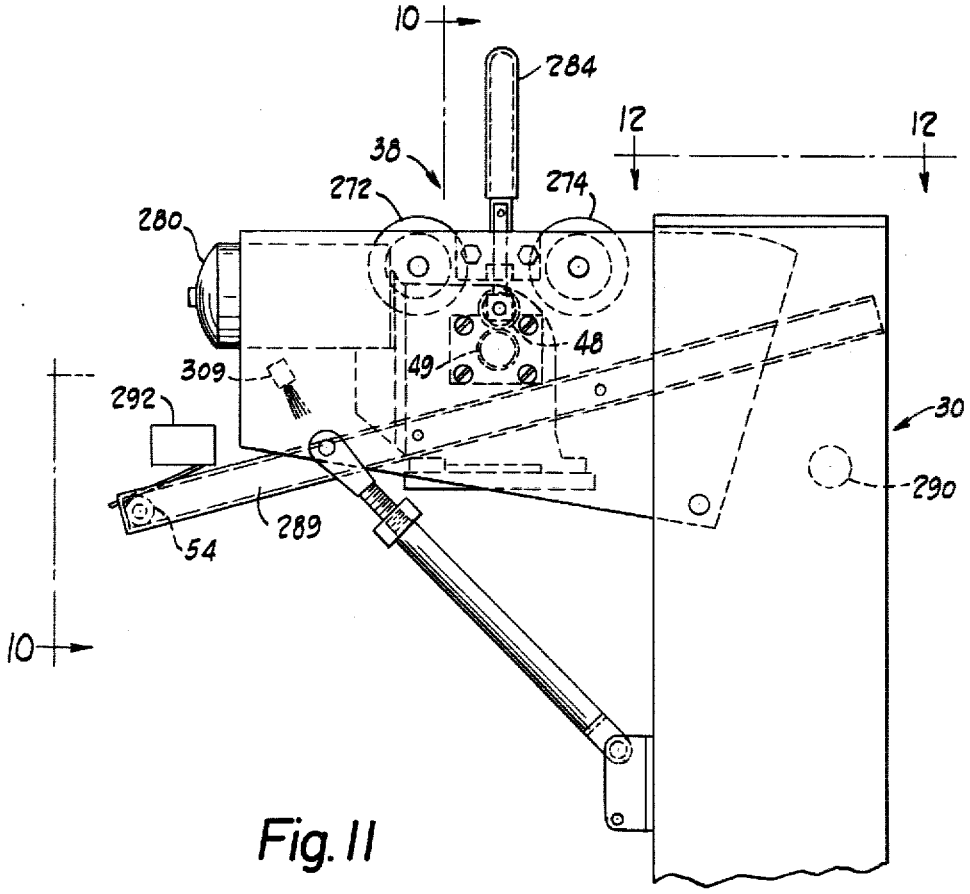
FIG. 11 is a side elevational view of the upper portion of the frame shown in FIGS. 2, 3 and 10.

As best shown in FIGS. 4, 10 and 11, the upper support and feed mechanism assembly 38 includes two freely rotatable rolls 272, 274 that craddle the roll of film 40 between them. The film is wrapped around the roll 274 and passes between the two superposed pinch rolls 48, 49, the lower of which is directly driven by an electric motor and gear box unit 280, carried on the side of the frame 30, as shown in FIG. 10. The upper pinch roll 48 is biased by compression springs 282 toward the lower roll, is releasable by handles 284, and is covered with a plastic sleeve 286 to assure traction. The film advanced through the pinch rolls is trained over the dancer roll 54, which is carried in elongated, inclined, guides 289 at each end of the roll, for travel. The film then is trained back to a roll 290 adjacent the upper limit of the seal bar travel on the frame 30, slightly behind the plane of seal bar travel, from where the film then extends down between the last roll of the input conveyor and the first roll of the output conveyor. Gravity urges the dancer roll 54 toward the lower ends of the guides 289, to establish a festoon or loop of material under slight tension. The dancer roll operates a switch 292 at the end of the guides, which switch controls the drive of the pinch rolls 48, 49, operating the pinch rolls to advance film from the supply roll when the dancer roll moves rearwardly from the end of the guides 289. Thus, feed of film is responsive to an article being fed through the film plane, which tensions the film, drawing the dancer roll along the guides 289 to the right in FIGS. 4 and 11, causing the switch 292 to begin the feed of film from the upper roll. The film is fed at a rate coordinated with the conveyor speed and pusher bar speed, to supply the film at the approximate rate required, at least to the extent that the festoon about the dancer roll, along with the feed rate, provides adequate film to wrap about the article as the article moves and the seal bar lowers. This is illustrated by the position of the dancer roll in FIG. 4C, where the need for film, as the article is moved forward, is partially met by the movement by the dancer roll to the right, permitting film to be drawn by the article and/or cutter bar at a rate faster than it is fed by the pinch roll, shortening the length of the festoon. As long as the dancer roll is removed from the end of the guides where the switch 292 is actuated, the pinch roll feed continues, allowing the dancer roll to move back toward the end of the guides under gravity, after the demand for film has lessened, and to thereby reestablish the festoon in preparation for the next wrapping cycle. When the dancer bar reaches the bottom of the guides, the switch 292 is actuated, stopping the motor drive to the pinch rolls (FIG. 4D).

Figure 16:
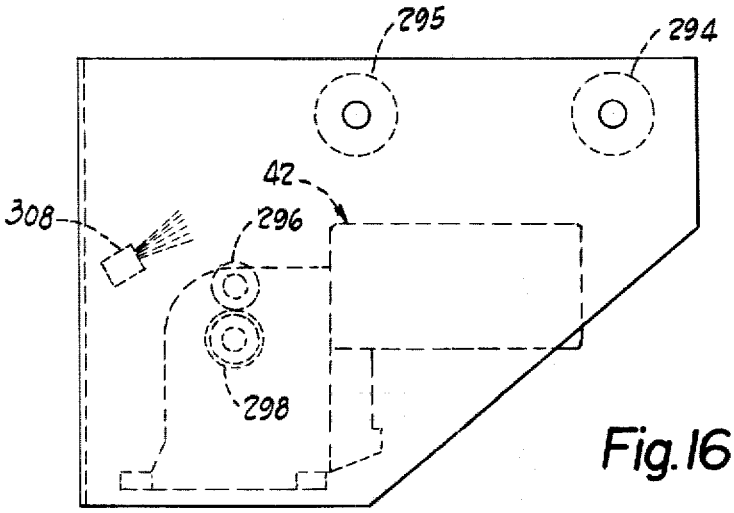
FIG. 16 is a view partly in section and partly in elevation showing the film support and drive rolls for the lower film supply.

The lower film support and feed mechanism 42 (FIGS. 4 and 16) operates similarly to the upper mechanism, although the construction and arrangement is slightly different. The lower support and feed mechanism 42 includes two freely rotatable rolls 294, 295, that cradle the film supply roll 44. The film is trained over the roll 294 and then back between two superposed pinch rolls 50, 51, one of which is covered with a plastic sleeve and is driven, as described in connection with the upper feed. The film is subsequently trained over one roll 300 and under another roll 301 of the pivoted bale 56 weighted to rotate in the clockwise direction as shown in FIG. 4. The film is then trained upward between the infeed and outfeed conveyors, where it joins the film from the upper supply roll 40. The bale 56 is comprised of a central pivot 303 and a frame 304 that connects the two rolls 300, and 301 for concurrent rotation about the pivot. The frame will normally maintain the position shown in FIG. 4A, i.e., with the roll 301 lower than the roll 300. When the bale pivots in a counterclockwise direction from the position in FIG. 4A, a switch 306 is operated to control the operation of the pinch rolls 50, 51 to feed film from the supply roll. Thus, as shown in FIG. 4B, the bale 56 rotates counterclockwise from the position in FIG. 4A when an article on the infeed conveyor tensions the film and draws the film forward along the conveyor. As the bale rotates, it supplies film to allow continued movement of the article along the conveyor path. At the same time, the pinch rolls begin to feed film across the bale to the film plane, substantially at the speed required by the movement of the article. When the article stops moving, i.e., when it has moved through the film plane to the position where the film is then sealed behind the article, the film feed continues for a time, allowing the bale to pivot back to the initial position, as shown in FIG. 4D, where it actuates the switch 306 to stop the film feed. It should be understood that, instead of the bale 56, a dancer roll and inclined guide could be used, as in the arrangement for the upper support and feed mechanism assembly. Such a modification is especially advantageous where the articles to be wrapped are extremely light in weight, because the dancer roll is more readily moved under a small force than is the bale.

Because the plastic film readily carries a static charge, which may make the feeding of the film somewhat difficult, wire brushes 308 associated with the lower feed and 309 associated with the upper feed are positioned adjacent the pinch rolls of each, in contact with the film, to conduct away the static electric charge (see FIGS. 4, 10 and 11).

Figure 17:
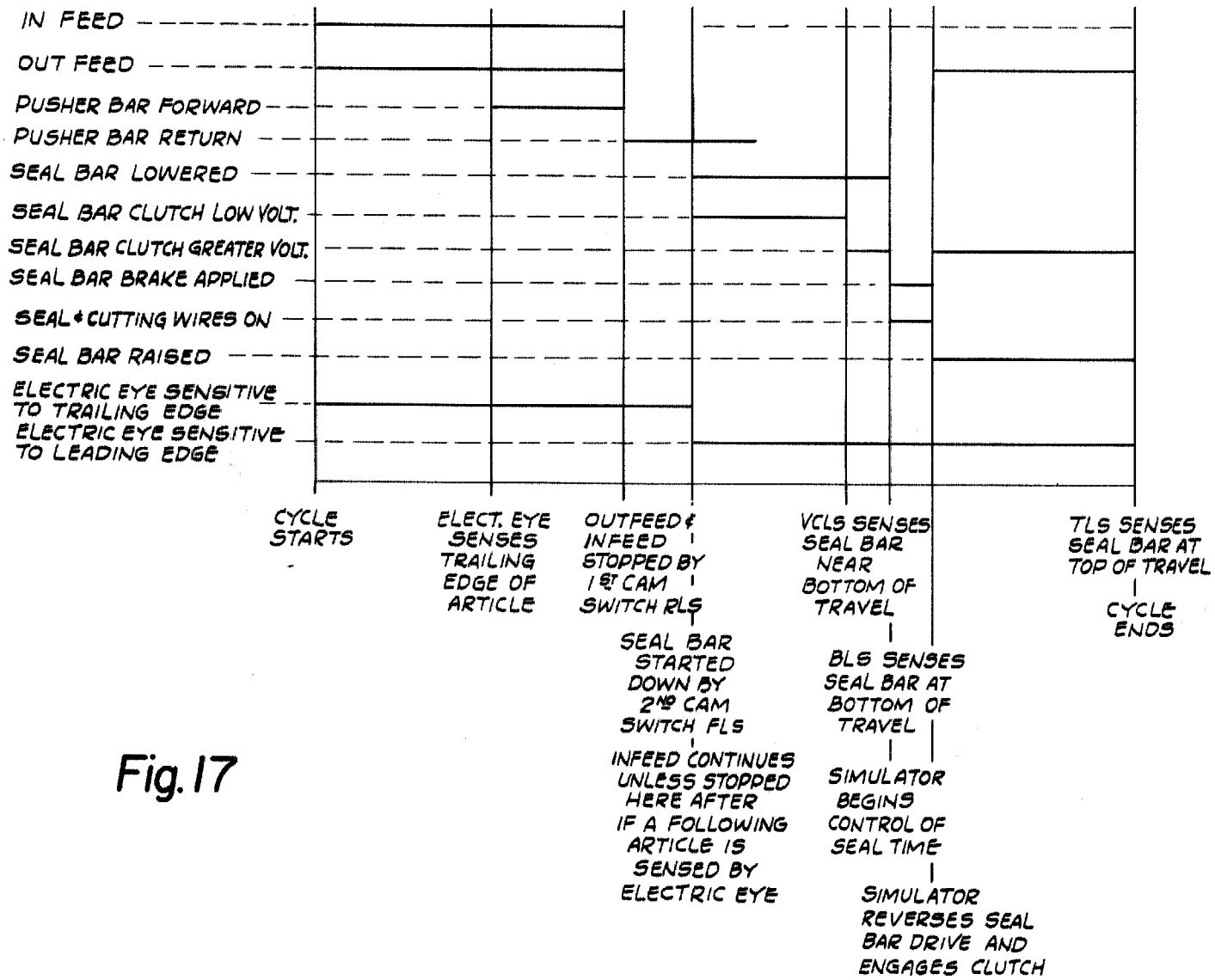
FIG. 17 is a diagram showing the sequence and duration of operation of various machine components.

The operation of the apparatus described is best summarized with reference to FIG. 17 of the drawings, which diagrammatically indicates the sequence and duration of pertinent machine functions in wrapping an article or articles.

Initially, the seal bar is in a raised position sufficiently high above the plane of the infeed and outfeed conveyors to accommodate the articles being wrapped. The film extends across the conveying path from the upper and lower supply of rolls 40, 44, and the infeed and outfeed conveyors are not operating. The machine is switched on to start the operation by causing the infeed and outfeed conveyors 26, 28 to operate. Thereafter, these conveyors are driven by continuously operating motors, with rotation of the rolls of each conveyor depending upon the actuation of the controlling solenoid-operated clutch-sprocket drives 92 on the infeed and 182 on the outfeed drive. An article to be wrapped is then placed on the infeed conveyor 26 and is moved toward the film plane by rotation of the rolls, which are pressed against the driving belts by the weight of the article. The phototube or electric eye 46 beneath the infeed conveyor near the film plane does not initially respond to the leading edge of an article, but to the trailing edge. Thus, articles of varying length can be wrapped without adjustment of the mechanism or cycle. In the preferred embodiment, the electric eye or phototube 46 is located just beyond the front cross bar 124 of the pusher bar assembly 126 and serves to initiate movement of the pusher bar once an article moves beyond the front cross bar. Thus, when a trailing end of an article the passes the phototube, the one-revolution clutch 102 is operated by a solenoid to rotate the drive disk 104 through one revolution, advancing and withdrawing the pusher bar assembly, causing it to engage the rear surface of the article and to positively advance the article forward through the film plane to a position beyond the plane of movement of the seal bar. The one revolution of the drive cam through the clutch 102 also rotates the two cam switches RLS, FLS through one revolution. In addition, as the pusher bar assembly advances the article through the film plane, the requirement for additional film moves the dancer roll 54 and bale 56, which causes the pinch rolls for the film feeds to be driven, to feed film from the upper and lower supply rolls. This is not shown in the timing diagram of FIG. 17, because the film supply responds independently of the operating cycle, in direct response to the need for film. The rate at which the pinch rolls supply film is controlled by setting in advance the speed of the motors driving the pinch rolls, based upon the requirements as determined by the article size and speed of conveying.

When the pusher bar reaches its forward position, where the article is located for completion of the wrapping by lowering of the seal bar, the cam switch RLS stops the outfeed conveyor by causing the clutch to the drive sprocket 182 to disengage. The pusher bar is returned by the second half of the single revolution of the drive disk 104. During return of the pusher bar assembly, it will pull in a rearward direction any article that may have been advanced too close to the seal bar frame 30.

As soon as the pusher bar is withdrawn behind the plane of seal bar movement, the second cam switch FLS, also driven by the shaft controlled by the one revolution clutch, is operated. This causes the seal bar to lower by actuating the voltage-sensitive clutch of the seal bar drive transmission of the drive motor 212. A reduced voltage is applied to the clutch so the seal bar is driven in a downward direction under the minimum force needed, taking into consideration the effect of gravity.

When the seal bar leaves its upper position, the circuits associated with the phototube or electric eye 46 are changed by the opening of the top limit switch TLS to produce a response to a leading edge of any following article on the infeed conveyor. This response stops the infeed conveyor by deenergizing the solenoid that engages the drive clutch of the infeed conveyor drive sprocket 92. In the absence of a following article being sensed, the infeed conveyor continues to operate to bring successive articles toward the film plane.

When the seal bar 32 approaches its lower, sealing, position, the limit switch VCLS is operated to apply a greater voltage to the clutch of the seal bar drive transmission so that greater force necessary to clamp the film together behind the article between the seal bar and anvil can be applied. At the bottom of the seal bar travel, i.e., when the seal bar is yieldably biased against the film and anvil by the compression springs of the cutter bar support, a brake on the seal bar drive is engaged and the clutch is released, in response to the actuation of the bottom limit switch BLS by a cam on the seal bar. Also, the control of the machine cycle is shifted to the simulator. Current is applied to the cutting and sealing elements of the seal bar for a time controlled by the simulator. At the end of this time, and after a preset cooling time, a relay is energized by the simulator to transfer control back to the control circuit, which then operates the reverse clutch of the transmission of the seal bar drive, causing the bar to be raised. Full voltage is applied to the clutch to assure the transmission of adequate force to raise the bar against gravity. Also, in response to upward movement of the seal bar and the release of the limit switch BLS, the outfeed conveyor begins operating again.

When the seal bar reaches the top of its travel, it is sensed by limit switch TLS which then opens the drive clutch of the seal bar drive to stop further movement of the seal bar and sets the machine back to the original state to end the cycle.

Figure 18:
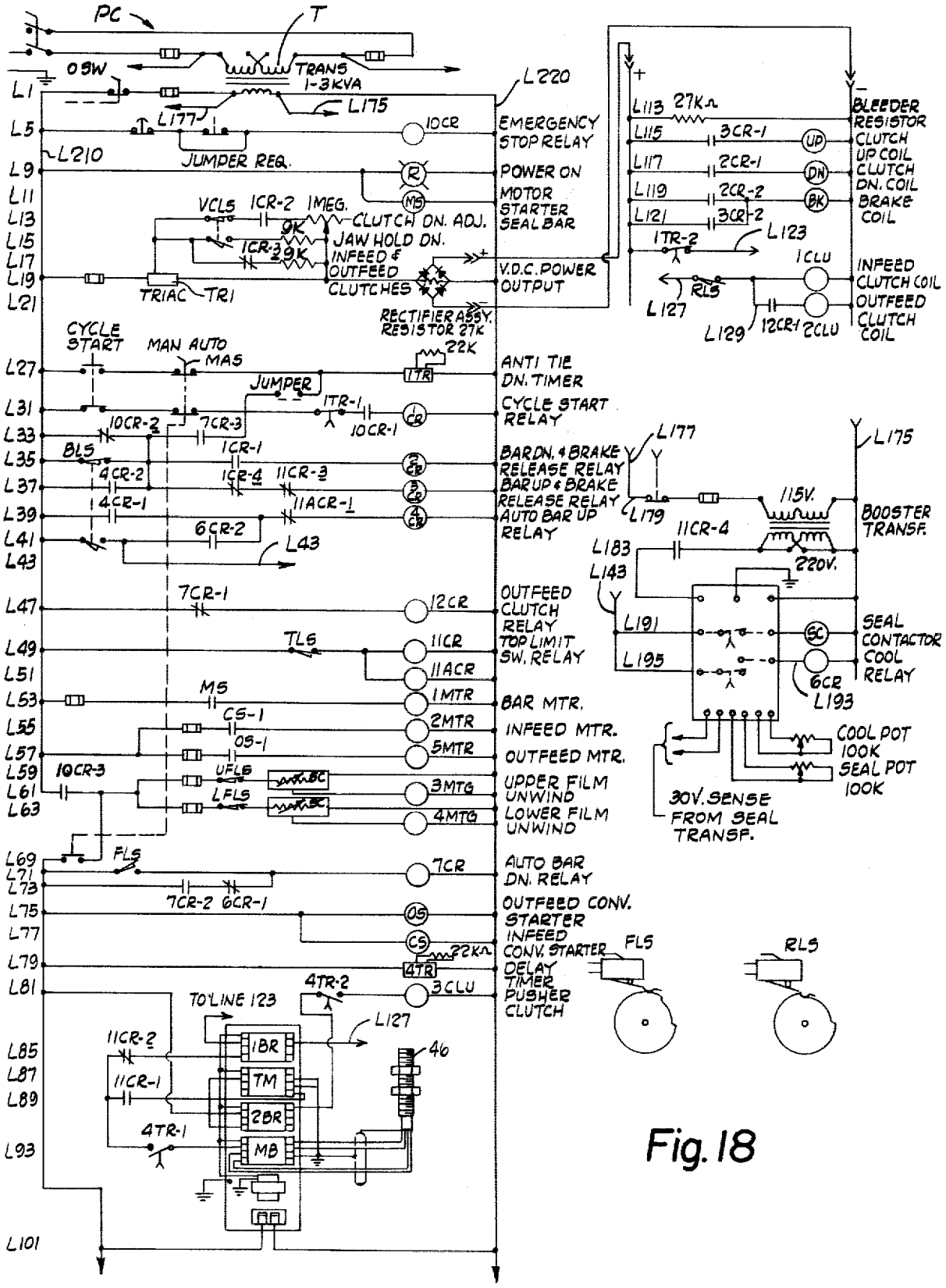
FIG. 18 is a diagram of the relay control circuit of the machine.

The electrical circuit for controlling the operation of the apparatus is diagrammatically shown in FIG. 18 of the drawings. In the following description, relays switches will be designated by the controlling relay number with a suffix numeral. The numeral will be underlined if the switch is normlly closed. Designations in parentheses will indicate the line number in the diagram of FIG. 18 in which the component is located. The control relays and associated switches are located in numbered circuit lines L1-L195 between main lines L210 and L220. Power is supplied from the secondary winding of a transformer T in a power circuit PC. While the circuit components and their operation will be apparent to one skilled in the art from the diagram, the principal components and their functions will be explained.

Operation is started by actuating the on switch OSW (L1), which operates the relay 10CR, which starts the seal bar operating motor MS (L11). By actuating the manual-automatic switch MAS (L27) to the automatic position, the contacts in line L69 are closed, causing power to be supplied to the outfeed and infeed motor starting relays OS (L75) and CS (L77) to operate the infeed and outfeed conveyor motors 2MTR, 5MTR (L55, L57) through contacts CS-1, OS-1, and will cause the coil 1CLU (L127) of the infeed clutch 92 of the conveyor drive to be energized through the initially closed cam operated limit switch RLS (L127). The limit switch RLS is initially held closed by the operating cam, which is mounted on the same shaft as the pusher bar driving disk 104. Line 127 which supplies power to the infeed clutch coil and outfeed clutch coil 2CLU through the switch RLS is connected to the main power line L1 through normally closed internal contacts of a relay 1BR (L85). The outfeed clutch coil 2CLU, in addition, requires actuation of the control relay 12CR to close the contacts 12CR-1 (L129). Relay 12CR (L47) is energized through the normally closed contact 7CR-1 (L47).

With the seal bar in its raised position at the start of the cycle, the top limit switch TLS (L49) is closed, energizing relay 11CR (L49) and relay 11ACR (L51). As a result, signals from the phototube 46 energize relay 2BR (L93), through an amplifier MB, through the now closed timer contact 4TR-1, which is initially open but closes after start up (the purpose being to prevent the pusher bar operation from cycling at start up), aand through the now closed contacts 11CR-1 (L89) to the timer module TM (L87), which only operates relay 2BR off of a second signal from the phototube 46 to the amplifier MB. The signal from the timer module TM goes to relay 2BR, which energizes momentarily to energize the pusher bar clutch 102 through the now closed timer contact 4TR-2 and the relay coil 3CLU (L81). As a result of the timer module operating off the second signal from the scanner, the signal will be produced only after a package has first been sensed by the phototube and thereafter passes by the phototube, resulting in the sensing of the trailing edge; that is, the change from no package being sensed to a package being sensed produced one signal, and the change from a package being sensed to no package being sensed produces a second signal that actuates the relay 2BR by virtue of internal logic in the component.

The second signal that energizes relay 3CLU causes the pusher clutch to rotate through one revolution, driving the pusher bar assembly 36 forward and then returns it to its initial position. When the pusher bar reaches the mid point of its travel, i.e., its forward position, the cam switch RLS (L127) opens, stopping both the infeed and the outfeed conveyors. However, as soon as the pusher bar is moved in its return path back past the initial plane of the film and the path of the seal bar, cam switch FLS (L71) is closed, energizing control relay 7CR (L71). The relay is held on through a holding circuit of line L73, through the now closed contact 7CR-2 and the normally closed contact 6CR-1. This opens the normally closed contacts 7CR-1 (L47) deenergizing the outfeed clutch coil 12CR, stopping the outfeed conveyor. However, the infeed conveyor is restarted because the cam controlling the switch RLS (127) recloses the switch during the return travel of the pusher bar. As a result, the infeed conveyor can continue to bring articles toward the frame 30. The normally closed switch 6CR-1 (L73) in the holding circuit for 7CR is operated off of the cool down control of the simulator to open the circuit and deenergize relay 7CR after the sealing operation, which in turn allows relay 12CR (L47) to be energized and operate the outfeed clutch to cause the outfeed conveyor to move the wrapped the package from the wrapping station.

Relay 1CR (L31) is energized through the switch 1TR-1, normally closed, and the contacts 10CR-1, now closed because relay 10CR (L5) has been energized. Relay 2CR (L35) is then energized through the closed contacts of BLS and the now closed contacts 1CR-1, to close contacts 2CR-1 (L117) to energize the clutch down coil DN (L117) of the seal bar drive. Contacts 2CR-2 (L119) close to release the seal bar brake by energizing the brake coil BK (L119), and the seal bar is driven downward. Also, as shown in lines L13 to L19, the energizing of relay 1CR closes contacts 1CR-2 and opens contacts 1CR-3 so that a one megohm resistor is placed in the circuit actuating the clutch, affecting the signal to a triac TR1, which reduces the voltage applied to actuate the voltage-sensitive clutch of the transmission 206 so the force transmitted through the clutch is reduced. When the seal bar approaches its lower position, a voltage change limit switch VCLS (L13, L15) is actuated to disconnect the resistor from the circuit and to place the clutch under its maximum duty cycle in which a greater voltage is applied and a greater force transmitted through the clutch.

With an article on the outfeed conveyor and being wrapped with film, relay 11CR (L49) is deenergized because the top limit switch TLS (L49) is open as the seal bar begins its downward movement. In those conditions, signals from the phototube 46 go to the relay module 1BR through the normally closed contacts 11CR-2 (L85) and an output is produced when a leading edge of the article is sensed. That is, relay 1BR is energized from the initial signal from the phototube 46. Upon energization of the relay 1BR, normally closed internal contacts in the circuit of line L127 are opened, breaking the circuit to the infeed clutch coil 1CLU and stopping the infeed conveyor. Thus, if the leading edge of a subsequent article is sensed by the phototube at a location adjacent the cutter bar while the cutter bar is moving downward, the infeed conveyor will be stopped.

When the seal bar reaches the lower limit of its travel, the bottom limit switch BLS (L35) is actuated, deenergizing relay 2CR and closing a contact in line L41. Relay 1CR is deenergized because relay 7CR has been deenergized by the opening of FLS, which opens contacts 7CR-3 (L33) and all control is transferred to the simulator (L43, L191, L193, L195). This energizes the seal contactor coil SC (L191) to energize the sealing wires of the seal bar, and both the heating and the cooling period are controlled by potentiometers that control relay switches to the seal contactor coil SC and to a cool relay 6CR (L193).

At this time, neither relay 11CR nor 11ACR is energized because the limit switch TLS (L49) is open. The bottom limit switch BLS (L41) is closed. Contacts 6CR-2 (L41) are closed by the energizing of the cool relay 6CR (L193) after an appropriate cooling period. As a result, relay 4CR (L39) is energized through 6CR2-2 and the normally closed contacts 11ACR-1 (L39) and is held energized by closing contacts 4CR-1 (L39). Accordingly, the seal bar is driven up, the brake being released and the clutch up coil UP(L115) being energized through relay 3CR (L37) by the closing of contacts 4CR-2 and 3CR-1 (L37 and L115). Full voltage is applied through the clutch because relay 1CR (L31) is deenergized and therefore contacts 1CR-2 (L13) are open and contacts 1CR-3 (L17) are closed. Upon the seal bar reaching its upper limit of travel, top limit switch TLS (L49) is closed, energizing relays 11CR and 11ACR. This deenergizes relays 3CR and 4CR to stop the seal bar at the upper position. This also reverts the scanner circuit (L81-L93) to send the signal to the timer module TM and relay 2BR.

In the event the seal bar does not reach its sealing position, timer relay 1TR (L27) is energized after a time delay and opens contacts 1TR-1 (L31), deenergizing relay 1CR, which turns off relay 2CR (L35), which tops the seal bar drive.

Suitable control modules 1BR, TM 2BR and MB referred to above are available from Banner Engineering Corporation, Minneapolis, Minn., and are commercially identified, respectively, as "12 volt relay 1BR-2, "Timer module 2PL4-2," "12 VDC Relay 2BR-2," and "Amplifier MB3-4."

While a preferred embodiment of the invention has been described in detail, it will be apparent that various modifications and alterations may be made therein without departing from the spirit and scope of the invention set forth in the appended claims.

I claim:

1. In a film wrapping machine having a conveyor for moving articles to be wrapped along a path, means to supply film from opposite sides of the conveyor across the path, and cooperating film sealing and severing means on opposite sides of the path relatively movable toward and away from the path to seal and sever the film behind a wrapped article or group of articles moved along the path, the improvement comprising a stationary guide along which sealing and severing means moves toward and away from the path on one side thereof, said guide being inclined relative to the plane of said path and forming an acute angle with the portion of the conveyor behind the location where the film crosses the path, to guide the movble sealing and severing means in a path that has a component of movement in the direction the article or articles being wrapped are moved along the conveyor when the sealing and severing means is moved toward the conveyor, and means adjustably supporting the guide to increase said component for tall articles, said movable sealing and severing means engaging the film on one side of the path during the movement of the severing and sealing means toward the conveyor and carrying it along said inclined path to the conveyor at a location behind the article or articles being wrapped, whereby adverse tensioning of the film over the article or articles in a rearward direction is inhibited.

2. A machine as set forth in claim 1 including a pivot support for said stationary guide, said pivot support being substantially in the plane of said path and perpendicular to the direction in which articles are moved and permitting adjustment of the angle at which said guide is inclined relative to the path, and means for releasably securing the guide at a selected angle of incline.

3. A machine as set forth in claim 2 including means to support both a roll of film and means to positively feed film from the roll on said stationary guide, for movement with the stationary guide upon adjustment of the angle thereof.

4. In a method of wrapping an article with a heat-sealable film, including the steps of extending the film across a path of article movement, moving an article along the path and into the film so the film extends over front and two adjacent surfaces of the article, bringing the film together behind the article, and sealing and severing the film, the improvement comprising bringing the film together behind the article in a path that has a component in the direction of article movement, and adjusting the path to provide a greater component with tall articles than with short.

5. In a film wrapping machine having a conveyor for moving articles to be wrapped along a path, means to supply film from opposite sides of the conveyor across the path, and cooperating film sealing and severing means on opposite sides of the path relatively movable toward and away from the path to seal and sever the film behind a wrapped article or group of articles moved along the path, the improvement comprising a pusher movable relative to the conveyor forward in the direction of article movement from a first position upstream of the sealing and severing means considered in the direction of article movement to a second position downstream thereof and back, means for sensing the trailing end of an article moved along the conveyor at a location upstream from the sealing and severing means and downstream of the pusher, and means responsive to the sensing of the trailing end of the article to move the pusher forward and back between said positions to positively move an article past the film sealing and severing means, said pusher beng located out of the conveying path when in said first position and including means to move a portion of the pusher into the conveying path in response to movement from said first position, to retain said portion in the path in a position to engage an article during movement of the pusher both forward and back, and to remove said portion from the conveying path in response to movement back to said first position and thereafter maintain it in said removed position in the absence of pusher movement, said pusher including a pusher member extending transversally across the conveyor and having front and rear surfaces normal to said direction of article movement and means for supporting said member so that said member is free from supporting structure at the front and rear of said member within the conveying path whereby the area directly behind and in front of the member is free and unobstructed by said support means and the member thereby can contact and move an article along the path in both forward and reverse directions, said pusher member engaging articles on the conveyor in its path during its reverse movement to assure that a next subsequent article is behind the sensing means.

6. A film wrapping machine comprising an infeed conveyor, means to drive and stop the infeed conveyor, an outfeed conveyor, means to drive the outfeed conveyor, the drive means of each conveyor being independent one from the other, said two conveyors being positioned in line, end to end to establish a conveying path and operable to convey articles in a common direction, means supplying and guiding wrapping film across the path defined by said conveyors and between the two, film sealing and severing means located between adjacent ends of the two conveyors and movable relative to said path to sever and seal the film, means for pushing said articles from said infeed conveyor into said film and onto said outfeed conveyor, means along the infeed conveyor for sensing an article conveyed on the infeed conveyor and to produce a signal when an article is sensed that controls movement of the article along the infeed conveyor, and means responsive to movement of the film sealing and severing means toward said path to selectively control whether a signal is produced in response to the sensing of a leading edge or a trailing edge of an article by the sensing means, whereby said pushing means for pushing an article from the infeed to the outfeed conveyor is activated by sensing an article trailing edge by said sensing means, and responsive to said movement of said film sealing and severing means, said sensing means senses the leading edge of the next article to cause said stopping means to stop the infeed conveyor to thereby prevent conveying of the next article across the path of the moving film sealing and severing means at an inappropriate time is prevented by sensing a leading edge.

7. In a method of wrapping an article with a heat-sealable film, including the steps of extending the film across a path of article movement, moving an article along the path and into the film so the film extends over front and two adjacent surfaces of the article, bringing the film together behind the article, and sealing and severing the film, the improvement comprising pushing the article along the path of article movement into the film and past the original location at which the film extends across the path, sensing a trailing edge of the article, initiating the pushing in response to the sensing of said trailing edge, bringing the film together behind the article in a path that has a component in the direction of article movement and adjusting the path to provide a greater component with tall articles than with short.

8. A method as set forth in claim 7 wherein the improvement includes moving a successive article along the path of article movement, sensing the leading edge of the successive article between the time said trailing edge is sensed and the bringing of the film together, and stopping the moving of said successive article in response to sensing of its leading edge.

9. In a film wrapping machine having a conveyor for moving articles to be wrapped along a path, means to supply film from opposite sides of the conveyor across the path, and cooperating film sealing and severing means on opposite sides of the path relatively movable toward and away from the path to seal and sever the film behind a wrapped article or group of articles moved along the path, the improvement comprising a stationary guide along which sealing and severing means moves toward and away from the path on one side thereof, said guide being inclined relative to the plane of said path and forming an acute angle with the portion of the conveyor behind the location where the film crosses the path, to guide the movable sealing and severing means in a path that has a component of movement in the direction the article or articles being wrapped are moved along the conveyor when the sealing and severing means is moved toward the conveyor, and means adjustably supporting the guide to increase said component for tall articles, said movable sealing and severing means engaging the film on one side of the path during the movement of the severing and sealing means toward the conveyor and carrying it along said inclined path to the conveyor at a location behind the article or articles being wrapped, whereby adverse tensioning of the film over thr article or articles in a rearward direction is inhibited, a pusher movable relative to the conveyor in the direction of article movement from a first position upstream of the sealing and severing means considered in the direction of article movement to a second position downstream thereof and back, means for sensing the trailing end of an article moved along the conveyor at a location upstream from the sealing and severing means and downstream of the pusher, means responsive to the sensing of the trailing end of the article to move the pusher forward and back between said positions to positively move an article past the film sealing and severing means, and means for thereafter sensing the leading edge of a subsequent article and to stop said conveyor in response thereto.

* * * * *